US007553181B1

(12) United States Patent
Van Dalinda, III

(10) Patent No.: US 7,553,181 B1
(45) Date of Patent: Jun. 30, 2009

(54) CORD CONNECTION DEVICE

(76) Inventor: William R. Van Dalinda, III, 53 Paradise Rd., Oakridge, NJ (US) 07438

( * ) Notice: Subject to any disclaimer, the term of this patent is extended or adjusted under 35 U.S.C. 154(b) by 0 days.

(21) Appl. No.: 12/104,665

(22) Filed: Apr. 17, 2008

(51) Int. Cl.
*H01R 13/62* (2006.01)

(52) U.S. Cl. ..... 439/369; 174/92

(58) Field of Classification Search ..... 439/367, 439/369; 174/92
See application file for complete search history.

(56) References Cited

U.S. PATENT DOCUMENTS

| | | | | |
|---|---|---|---|---|
| 4,643,505 | A | 2/1987 | House et al. | |
| 4,869,683 | A | 9/1989 | Nelson | |
| 5,066,905 | A * | 11/1991 | Betton et al. | 324/133 |
| 5,129,839 | A | 7/1992 | VanSkiver | |
| 5,135,409 | A | 8/1992 | Thompson | |
| D332,940 | S | 2/1993 | Finlay | |
| 5,217,387 | A | 6/1993 | Hull et al. | |
| 5,259,782 | A | 11/1993 | Giffin | |
| 5,505,634 | A | 4/1996 | Osten | |
| 6,602,087 | B1 | 8/2003 | Carle | |

* cited by examiner

*Primary Examiner*—Truc T Nguyen
(74) *Attorney, Agent, or Firm*—Crossley Patent Law; Mark A. Crossley

(57) ABSTRACT

A cord connection device that is used to secure the connection between two existing extension cords or between a power tool and an extension cord. The device has an outer casing that is split in two parts which are pivotally attached to one another along their length, with the outer casing being tapered inward toward each of its ends to allow a better fit around the body of each of the cords. The plugs of the cords are connected to one another within the outer casing and have an intervening contact plate located in between them. The contact plate is connected via a wire to a light emitting diode (LED) that is located on the exterior of the outer casing, with the LED lighting up when current is passing through the connected cords.

4 Claims, 3 Drawing Sheets

CORD CONNECTION DEVICE

BACKGROUND OF THE INVENTION

The present invention concerns that of a new and improved cord connection device that is used to secure the connection between two existing extension cords or between a power tool and an extension cord.

SUMMARY OF THE INVENTION

The present invention concerns that of a new and improved cord connection device that is used to secure the connection between two existing extension cords or between a power tool and an extension cord. The device has an outer casing that is split in two parts which are pivotally attached to one another along their length, with the outer casing being tapered inward toward each of its ends to allow a better fit around the body of each of the cords. The plugs of the cords are connected to one another within the outer casing and have an intervening contact plate located in between them. The contact plate is connected via a wire to a light emitting diode (LED) that is located on the exterior of the outer casing, with the LED lighting up when current is passing through the connected cords.

There has thus been outlined, rather broadly, the more important features of a cord connection device that the detailed description thereof that follows may be better understood and in order that the present contribution to the art may be better appreciated. There are, of course, additional features of the cord connection device that will be described hereinafter and which will form the subject matter of the claims appended hereto.

In this respect, before explaining at least one embodiment of the cord connection device in detail, it is to be understood that the cord connection device is not limited in its application to the details of construction and to the arrangements of the components set forth in the following description or illustrated in the drawings. The cord connection device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present cord connection device. It is important, therefore, that the claims be regarded as including such equivalent constructions insofar as they do not depart from the spirit and scope of the present invention.

It is therefore an object of the present invention to provide a cord connection device which has all of the advantages of the prior art and none of the disadvantages.

It is another object of the present invention to provide a cord connection device which may be easily and efficiently manufactured and marketed.

It is another object of the present invention to provide a cord connection device which is of durable and reliable construction.

It is yet another object of the present invention to provide a cord connection device which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
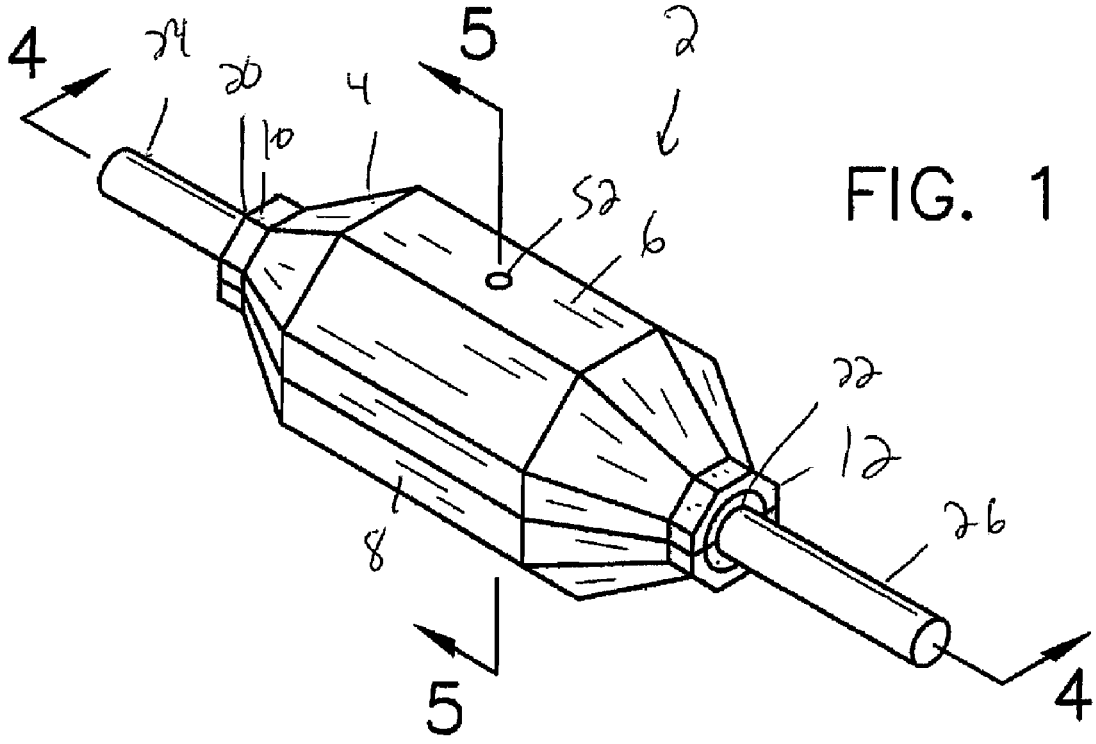
FIG. 1 shows a perspective view of the cord connection device as it would appear in use with the outer casing in a closed position.
Figure 2:
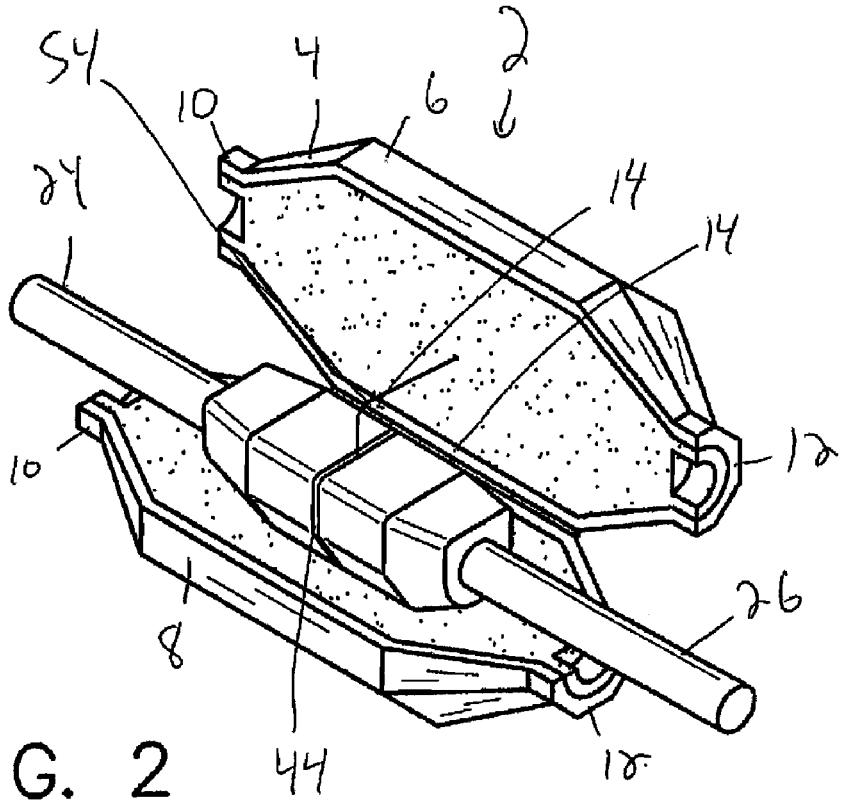
FIG. 2 shows a perspective view of the cord connection device as it would appear in use with the outer casing in an open position.
Figure 3:
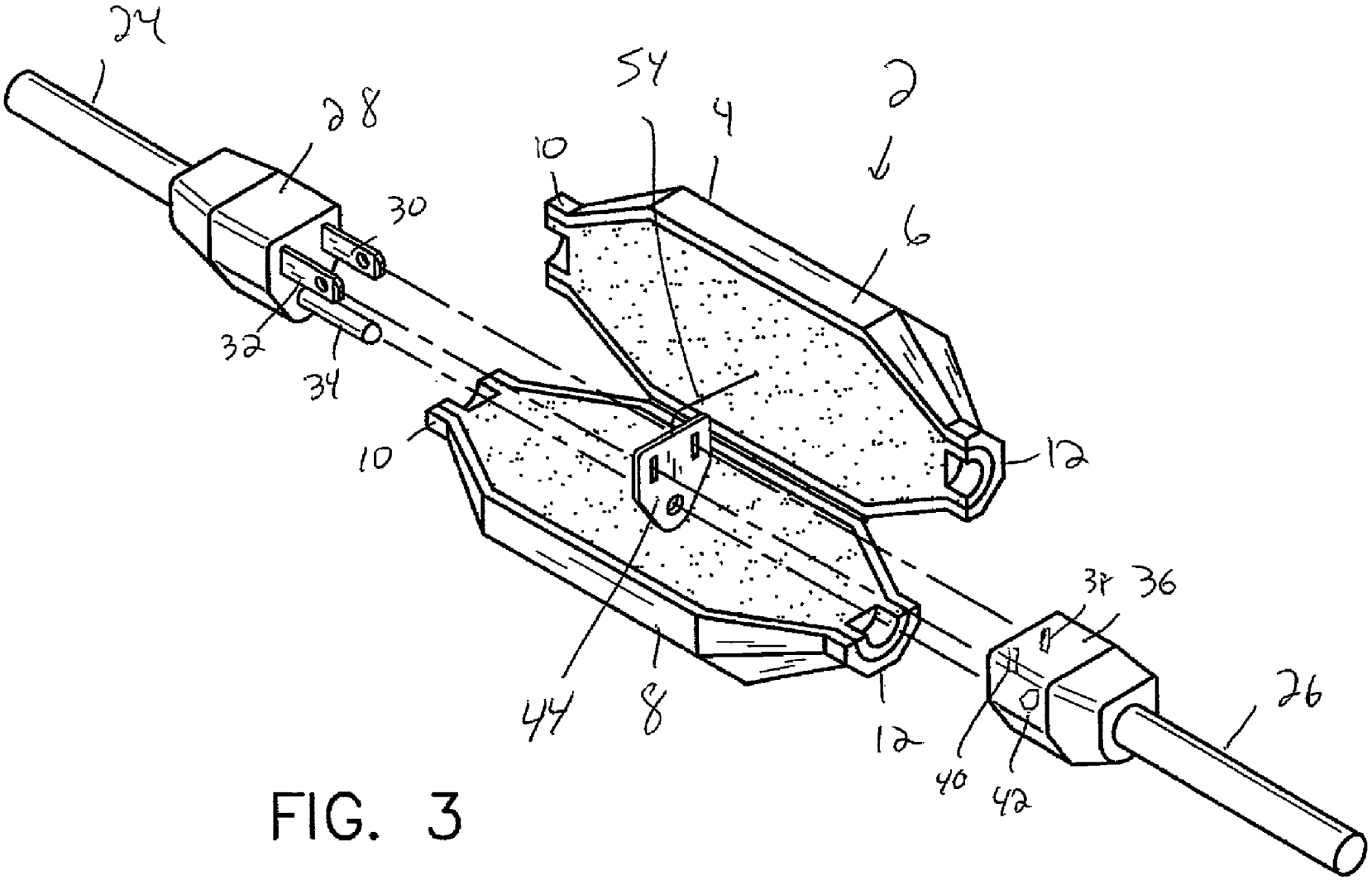
FIG. 3 shows a perspective view of the cord connection device as it would appear in use with the outer casing in an open position after a pair of extension cords have been pulled apart from one another.
Figure 4:
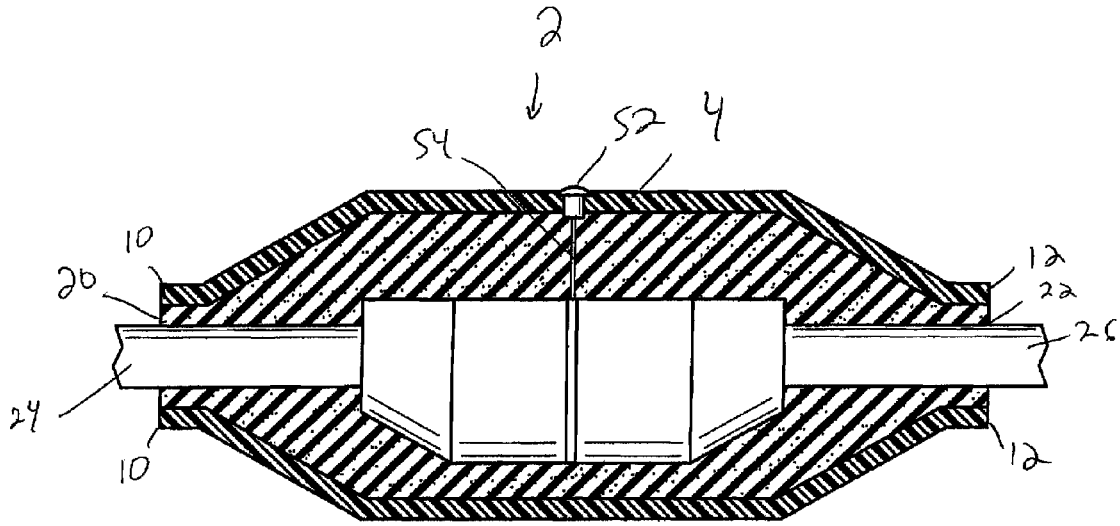
FIG. 4 shows a side cutaway view of the cord connection device as it would appear in use with the outer casing in a closed position.
Figure 5:
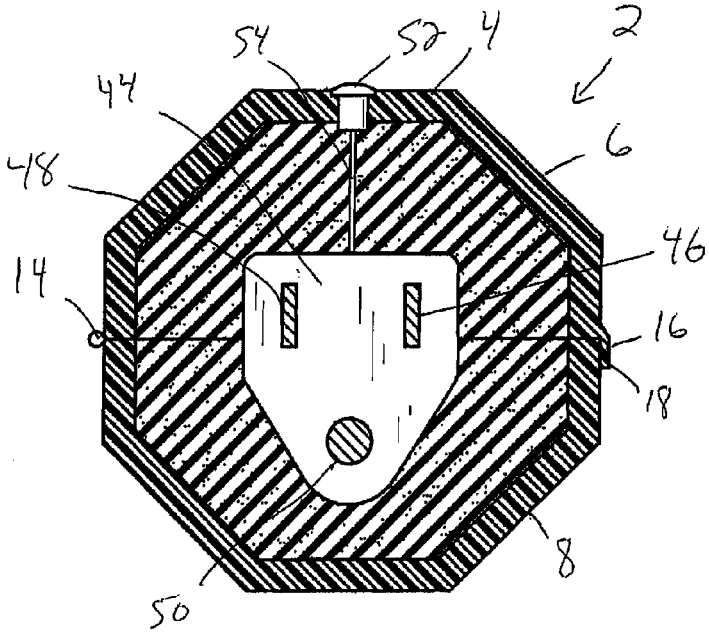
FIG. 5 shows an end cutaway view of the cord connection device as it would appear in use with the outer casing in a closed position.

With reference now to the drawings, and in particular to FIGS. 1 through 5 thereof, a new cord connection device embodying the principles and concepts of the present invention and generally designated by the reference numeral 2 will be described.

As best illustrated in FIGS. 1 through 5, the cord connection device 2 comprises an outer casing 4 that is fabricated from a first section 6 and a second section 8. Each of the sections 6 and 8 has two ends comprising a first end 10 and a second end 12, and furthermore each of the sections 6 and 8 has an equal length as compared to each other.

The first section 6 and second section 8 are pivotally attached to one another along their lengthwise axis by a series of hinges 14. To make sure the first section 6 and the second section 8 stay closed in relation to one another once the outer casing 4 is closed, the first section 6 has a male closure device 16 that mates with a female closure device 18 on the second section 8.

When the first section 6 and the second section 8 are closed in relation to one another, a first hole 20 is present at the first end of each of the two sections 6 and 8 and a second hole 22 is present at the second end of each of the sections 6 and 8. Furthermore, the first section 6 and second section 8 together have an octagonal cross-sectional shape that allows the outer casing 4 to be compact, but at the same time, not have the outer casing 4 of the device 2 roll around while the device 2 is lying around on a floor surface.

The device 2 is used to connect two cords 24 and 26 to one another. Cord 24 has a male receptacle 28 on it with prongs 30 and 32 and ground 34, while cord 26 has a female receptacle 36 on it with prong receiving holes 38 and 40 and ground receiving hole 42. When the two receptacles 28 and 36 are connected prongs 30 and 32 are inserted into prong receiving holes 38 and 40, respectively, while ground 34 is inserted into ground receiving hole 42.

The device 2 further includes a contact plate 44 that is capable of carrying current. The contact plate 44 is designed to be inserted in between the tow receptacles 28 and 36 when they are connected and includes prong holes 46 and 48 and ground hole 50. Prior to male receptacle 28 being connected to female receptacle 36, prongs 30 and 32 are inserted through prong holes 46 and 48 on the contact plate 44 and ground 34 is inserted through ground hole 50 on the contact plate 44.

Device 2 also includes a light emitting diode (LED) 52 that is located on the first section 6 of the outer casing 4. LED 52 is connected to contact 50 by a wire 54. When the device 2 is in use and cords 24 and 26 are conducting current in between them, LED 52 will light up and give an external indicator to an individual that the device 2 is currently on and functioning.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A cord connection device comprising:

an outer casing comprising two sections comprising a first section and a second section, each section having two ends comprising a first end and a second end, wherein each of the sections has a length, the length of each section being the same, a pair of cords comprising a first cord and a second cord, means for pivotally attaching the first section of the outer casing to the second section of the outer casing, means for removably attaching the first section of the outer casing to the second section of the outer casing, means for connecting the first cord to the second cord within the outer casing, and means for monitoring whether current is traveling through the pair of cords when they are connected to one another, wherein the means for pivotally attaching the first section of the outer casing to the second section of the outer casing further comprises a plurality of hinges, wherein each of the hinges is attached to both the first section and the second section of the outer casing, further wherein each hinge of the plurality of hinges is attached to both the first section and the second section along the lengthwise axis of the two sections, wherein the means for removably attaching the first section of the outer casing to the second section of the outer casing further comprises a male closure device attached to the first section, a female closure device attached to the second section, wherein the male closure device mates with the female closure device when the first section of the outer casing is closed in relation to the second section of the outer casing, wherein the device further comprises a first hole located at the combined first ends of the first section and the second section, and a second hole located at the combined second ends of the first section and the second section, wherein the means for connecting the first cord to the second cord within the outer casing further comprises a male receptacle attached to the first cord, the male receptacle further comprising a pair of prongs comprising a first prong and a second prong, the male receptacle further comprising a ground, a female receptacle attached to the second cord, the female receptacle further comprising a pair of prong receiving holes comprising a first prong receiving hole and a second prong receiving hole, the male receptacle further comprising a ground receiving hole, wherein the first prong of the male receptacle is inserted into the first prong receiving hole in the female receptacle, wherein the second prong of the male receptacle is inserted into the second prong receiving hole in the female receptacle, further wherein the ground of the male receptacle is inserted into the ground receiving hole in the female receptacle, wherein the means for monitoring whether current is traveling through the pair of cords when they are connected to one another further comprises a contact plate located within the outer casing, the contact plate having a pair of prong holes comprising a first prong hole and a second prong hole, the contact plate also having a ground hole, a monitoring mechanism attached to the contact plate, wherein the first prong of the male receptacle is inserted through the first prong hole of the contact plate prior to being inserted into the first prong receiving hole, further wherein the second prong of the male receptacle is inserted through the second prong hole of the contact plate prior to being inserted into the second prong receiving hole, further wherein the ground of the male receptacle is inserted through the ground hole prior to being inserted into the ground receiving hole on the female receptacle, further wherein the monitoring mechanism relays whether current is passing through the first and second cords.

2. A cord connection device according to claim 1 wherein the monitoring mechanism attached to the contact plate further comprises (a) a light emitting diode attached to the outer casing, (b) a wire connected to the light emitting diode, the wire also being connected to the contact plate, (c) wherein the light emitting diode will light up when current is passing through the contact plate.

3. A cord connection device according to claim 2 wherein the outer casing has an octagonal cross-sectional shape.

4. A cord connection device comprising (a) an outer casing comprising two sections comprising a first section and a second section, each section having two ends comprising a first end and a second end, wherein each of the sections has a length, the length of each section being the same, wherein the outer casing has an octagonal cross-sectional shape, (b) a pair of cords comprising a first cord and a second cord, (c) means for pivotally attaching the first section of the outer casing to the second section of the outer casing, said means further comprising (i) a plurality of hinges, wherein each of the hinges is attached to both the first section and the second section of the outer casing, (ii) further wherein each hinge of the plurality of hinges is attached to both the first section and the second section along the lengthwise axis of the two sections, (d) means for removably attaching the first section of the outer casing to the second section of the outer casing, said means further comprising (i) a male closure device attached to the first section, (ii) a female closure device attached to the second section, (iii) wherein the male closure device mates with the female closure device when the first section of the outer casing is closed in relation to the second section of the outer casing, (e) means for connecting the first cord to the second cord within the outer casing, said means further comprising (i) a male receptacle attached to the first cord, the male receptacle further comprising a pair of prongs comprising a first prong and a second prong, the male receptacle further comprising a ground, (ii) a female receptacle attached to the second cord, the female receptacle further comprising a pair of prong receiving holes comprising a first prong receiving hole and a second prong receiving hole, the male receptacle further comprising a ground receiving hole, (iii) wherein the first prong of the male receptacle is inserted into the first prong receiving hole in the female receptacle, (iv) wherein the second prong of the male receptacle is inserted into the second prong receiving hole in the female receptacle, (v) further wherein the ground of the male receptacle is inserted into the ground receiving hole in the female receptacle, (f) means for monitoring whether current is traveling through the pair of cords when they are connected to one another, said means further comprising (i) a contact plate located within the outer casing, the contact plate having a pair of prong holes comprising a first prong hole and a second prong hole, the contact plate also having a ground hole, (ii) a monitoring mechanism attached to the contact plate, said monitoring mechanism further comprising (1) a light emitting diode attached to the outer casing, (2) a wire connected to the light emitting diode, the wire also being connected to the contact plate, (3) wherein the light emitting diode will light up when current is passing through the contact plate, (iii) wherein the first prong of the male receptacle is inserted through the first prong hole of the contact plate prior to being inserted into the first prong receiving hole, (iv) further wherein the second prong of the male receptacle is inserted through the second prong hole of the contact plate prior to being inserted into the second prong receiving hole, (v) further wherein the ground of the male receptacle is inserted through the ground hole prior to being inserted into the ground receiving hole on the female receptacle, (vi) further wherein the monitoring mechanism relays whether current is passing through the first and second cords, (g) a first hole located at the combined first ends of the first section and the second section, (h) a second hole located at the combined second ends of the first section and the second section.

* * * * *